United States Patent [19]

Eigenmann

[11] Patent Number: 4,652,172

[45] Date of Patent: Mar. 24, 1987

[54] METHOD AND EQUIPMENT FOR IMPROVING HORIZONTAL MARKING STRIPS

[76] Inventor: Ludwig Eigenmann, P.O. Box 114, CH-6833 Vacallo, Switzerland

[21] Appl. No.: 847,158

[22] Filed: Apr. 2, 1986

Related U.S. Application Data

[63] Continuation of Ser. No. 521,731, Aug. 9, 1983, Pat. No. 4,607,978.

[30] Foreign Application Priority Data

| | | | |
|---|---|---|---|
| Aug. 23, 1982 | [IT] | Italy | 22934 A/82 |
| Dec. 29, 1982 | [IT] | Italy | 25023 A/82 |
| Jul. 6, 1983 | [IT] | Italy | 21961 A/83 |

[51] Int. Cl.[4] ..... E01C 23/16

[52] U.S. Cl. ..... 404/73; 404/14; 404/94; 427/137; 156/71

[58] Field of Search ..... 404/6, 9, 12–16, 404/72, 73, 82, 93, 94; 427/137; 156/71, 523, 574, 577

[56] References Cited

U.S. PATENT DOCUMENTS

| | | | |
|---|---|---|---|
| 3,418,896 | 12/1968 | Rideout | 404/14 X |
| 3,556,637 | 1/1971 | Palmquist | 404/16 X |
| 3,587,415 | 6/1971 | Eigenmann | 404/14 |
| 3,935,365 | 1/1976 | Eigenmann | 428/323 |
| 4,020,211 | 4/1977 | Eigenmann | 404/14 X |
| 4,030,958 | 6/1977 | Stenemann | 404/94 X |
| 4,072,403 | 2/1978 | Eigenmann | 404/6 X |
| 4,279,534 | 7/1981 | Eigenmann | 404/72 |
| 4,288,487 | 9/1981 | Eigenmann | 427/137 X |
| 4,322,177 | 3/1982 | Eigenmann | 404/93 X |
| 4,369,001 | 1/1983 | Eigenmann | 404/94 |

*Primary Examiner*—Stephen J. Novosad
*Assistant Examiner*—John F. Letchford
*Attorney, Agent, or Firm*—Michael J. Striker

[57] ABSTRACT

This invention regards a method for assuring high retro-reflecting capability and long service life for horizontally-installed roadway-marking strips. The same method also provides for making marking strips that are already installed visible in rainy weather. This invention also concerns the relative equipment for applying the method.

3 Claims, 9 Drawing Figures

FIG. 1″

METHOD AND EQUIPMENT FOR IMPROVING HORIZONTAL MARKING STRIPS

This is a continuation of application Ser. No. 521,731, filed Aug. 9, 1983, now U.S. Pat. No. 4,607,978.

BACKGROUND OF THE INVENTION

Over a period of several years, the Applicant for this patent has developed numerous inventions for improving the effectiveness of horizontally-installed roadway-marking strips, especially as regards the visibility of the strips under such adverse conditions as darkness and rainy weather.

Among these inventions, there is one covered by Italian Pat. No. 811,581, dated May 2, 1968, and U.S. Pat. No. 3,587,415, plus many Italian patents, applications and several corresponding patents granted in the U.S. All these inventions brought about a gradual improvement in the optic incorporated in the marking strips. The retro-reflecting capability of the optics was improved so that a greater percentage of light was reflected back to the driver from the headlights; the optical service life was extended and, also, the marking strip acquired anti-skid properties. Italian Pat. No. 24096 A/76, filed on June 9, 1976, concerned a further improvement: a retro-reflecting globule (also referred to hereafter as "asymmetrical pearl"). The special, asymmetrical shape of the pearl improved the optical characteristics, which were further enhanced by a layer of microspheres covering the underside of the globule. Other patents corresponding to this Italian patent were also obtained in the U.S., with U.S. Pat. No. 4,072,403, and in several other countries including Great Britain, Sweden and Canada.

More inventions followed, which concerned the method for depositing the optical elements and the relative equipment to do this, and ways of improving the optical efficiency of the elements as, for example, by making them have a double assymetry.

A special application method and relative applicating device have also been developed, whereby the optical elements can be deposited onto the horizontal roadway-marking strip in a predetermined alignment pattern, thus obtaining maximum efficiency. These inventions are covered by U.S. Pat. Nos. 4,279,534, dated July 21, 1981, No. 4,322,177, dated Mar. 30, 1982 and No. 4,369,001, dated Jan. 18, 1983.

A further step ahead was made by reducing the calendered ribbon of retro-reflecting elements to transverse strips, thus producing a product which is particularly suited for marking large surface areas. The transverse strips are primarily supported on rubber sheets, as shown in British Pat. No. 2,013,265, dated Mar. 3, 1982, obtained in Great Britain.

SUMMARY OF THE INVENTION

It is an object of this invention to provide all kinds of retro-reflecting devices which can be made by agglomerating optical elements in ribbon form, as described below. The idea of this invention is to provide another important improvement and consists of the manufacturing and depositing of small plates of agglomerated retro-reflecting material which is capable of providing even economical types of roadway-marking strips with long-lasting, retro-reflectivity. Various types of devices for depositing the retro-reflecting, pearl-agglomerate platelets onto the surface of the roadway also form part of this invention and are described below.

BRIEF DESCRIPTION OF THE DRAWING

FIG. 1″ shows a platelet consisting of an agglomerate of pearls and obtained from the aforementioned ribbon.

DETAILED DESCRIPTION OF THE PREFERRED EMBODIMENTS

Figure 1:
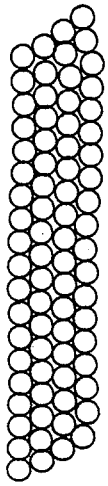
FIG. 1′ shows a narrow, perpendicular ribbon of asymmetric, retro-reflecting pearls, obtained from a manufactured item.
Figure 2A:
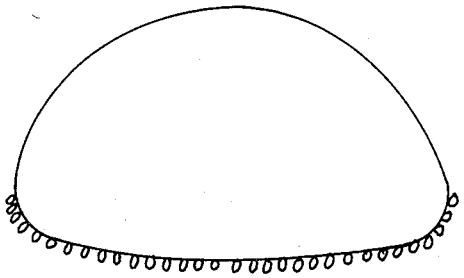
FIG. 2*a* shows, in a very enlarged scale, a pearl before being subjected to the impact of the traffic.

As mentioned previously, optical efficiency can be improved by depositing the retro-reflecting pearls in rows. According to this invention, it was found that if the strips of pearls are obtained from narrow, ribbons (FIG. 1′), instead of from transverse sections, the resulting optical-component platelets thus obtained (FIG. 1″) are very suitable and economical, their reduced required support area making them compatible with the asperity of the roadway surfaces. Furthermore, their lower cost makes them suitable for substituting the aligned pearls.

The double-focusing, retro-reflecting pearls, which are also called retro-reflecting globules, are made of a plastic material. The globules do not become opaque with exposure to traffic wear as do glass globules. The traffic passing over them actually polishes the plastic globules, but the plastic wears away and thus their optical service life is rather short.

Figure 2B:
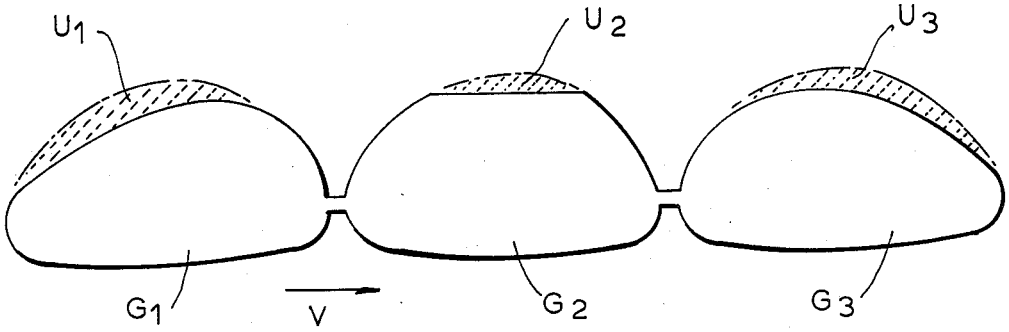
FIG. 2*b* shows a schematic representation of the wearing effect that passing road traffic has on the pearls.

When three or more rows of pearl conglomerates are used, it was found that the optical service life is greatly extended. The reason this happens is because the first row absorbs the full impact of the automobile tires and sustains the major part of the overall wear while the middle row, or rows, are only slightly worn on the top portion. The asymmetric wear on the first row also occurs on the last row, where the automobile tires leave the platelet. The attached drawings, especially FIG. 2*b*, show the typical wear pattern after a certain length of exposure to passing traffic. In FIG. 2*b*, the globules are indicated by the letters $G_1$, $G_2$ and $G_3$ while the worn away portions are indicated with the corresponding letters $U_1$, $U_2$ and $U_3$. The direction of traffic is indicated by the letter "V". The wear pattern is practically symmetrical about the platelet centerline with portion $U_1$ being most worn towards the side with which the tires first come in contact, and portion $U_3$ being most worn towards the side which lasts contacts the passing tire. Portion $U_2$, as seen, is only worn at the top. These platelets can, therefore, be called "symmetrically wearing" platelets, with reference to their centerlines, and can also be used to take the place of rows of individual retro-reflecting elements.

The various techniques used for applying or installing different types of roadway markings have been used for a long time and are well known, much of it being done by the simple spraying or brushing on of paint while another very important method being the installation of thermoplastic markings, this latter type being of a permanent nature and measuring 3 mm in thickness. All the various kinds of roadway markings, however, have one serious drawback: visibility of the markings at night or in rainy weather is not good. The thermoplastic, or so-called "hot-plastic", roadway markings are used the world over but, in the strictest sense, are not entirely effective in providing the required amount of safety. There not being anything available which is superior to the "hot-plastic" roadway marking, the use of this type of marking is accepted and tolerated.

The markings being poorly visible at night, the "hot-plastic" type is often sprayed with a light-reflexing paint, which only provides a temporary solution because of its being effective for only a short period of time. Another more effective but much more expensive solution is the interspersing of light-reflexing buttons in the strip when installing it. Besides the serious drawback of the high cost of this method, there is also the drawback of its losing 50% optical efficiency after only one year of service, plus the fact that its installation causes the road surface to deteriorate more rapidly.

The Applicant has contributed a noteworthy solution to the problem of poor night and rainy weather visibility by developing special prefabricated marking strips. These special marking strips also incorporate, generally but not necessarily, high-hardness crystal particles which provide anti-skid properties for the strips. As regards this aspect of the marking strip, reference is made, for example, to U.S. Pat. Nos. 3,935,365 and No. 4,020,211. Various systems and means have been devised for assuring nighttime visibility of the prefabricated marking strips when struck by such low-angle lighting as produced by automotive headlights. In this regard, reference is made to U.S. Pat. Nos. 3,587,415 and No. 3,746,425, French Pat. No. 1,578,688 and British Pat. No. 1,245,834.

The Applicant has developed a series of optical components which provide considerable visibility for marking strips at night and especially during rainy weather. In this regard, reference is made to U.S. Pat. Nos. 4,072,403 and No. 4,129,397. The inventor has thus developed various types of composite, prefabricated strips for making and installing roadway-marking strips which incorporate special, sophisticated optical components that guarantee a high degree of visibility and safety even under rainy conditions.

The rather expensive innovations, which considerably improve night-driving safety, are being introduced slowly on the international market, the funds available to the road and highway maintenance departments not being sufficient in most cases to permit more extensive use. Meanwhile, the public continues to run excessive risks when driving at night or in rainy weather. It is a real problem, therefore, which can only increase rather than decrease unless positive steps are taken to provide the kind of roadway-marking strips which are optically efficient in any kind of light or weather and maintain this efficiency for years.

When considering the ever-increasing amount of road traffic in the world, the magnitude of the problem and important of coping with it satisfactorily becomes quite evident.

One positive solution is the depositing of agglomerate platelets, which form the object of this invention, onto marking strips which are in the process of being installed on the roadway surface, such as the "hot-plastic" type of roadway marking. The additional cost involved would be modest and, as a rule, no additional adhesive material would be required to apply the platelets. The platelets, however, must be deposited while the plastic material is in its fluid state.

Another positive solution is the depositing of the platelets on roadway markings already installed on the surface of the roadway. This involves the application of an adhesive material either onto the roadway marking surface or on the underside of the platelets. Various types of suitable adhesives are found on the market which are compatible with the roadway marking itself and are resistant to hydrolysis. The platelets are then attached to the roadway marking and provide the desired visibility.

According to this invention, the above-mentioned method has the following advantages:

(1) The use of a high-quality, rapidly-setting adhesive, requiring little or no solvent, due to the small amount needed (considering that the overall use of sprayed road markings with optical components represents a very limited proportion of the marked area).

(2) The use, also, of smaller-sized, lower-cost platelets whose service life is proportional to that of the roadway marking already in service. The smaller size does not constitute any appreciable increase in thickness.

(3) The marking strip already in service and modified according to this invention does not undergo any practical changes, thereby mantaining all of its original characteristics.

Figure 3:
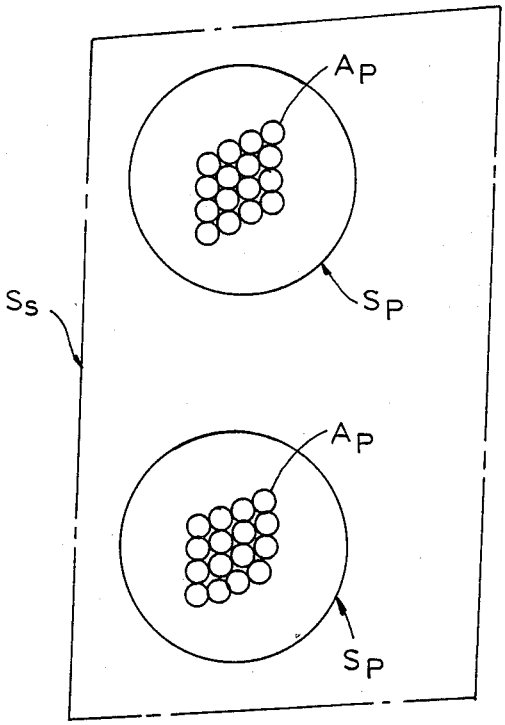
FIG. 3 shows a section of roadway marking—which was applied to the roadway surface by means of spraying—upon which the retro-reflecting, pearl-agglomerate platelets are being deposited.
Figure 3:
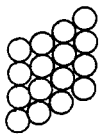

FIG. 3, view Ss, shows a section of a sprayed-on, horizontal marking strip, applied with the use of well-known equipment. Spray layers, Sp, of adhesive, using little or no solvent, are applied to the marking strip, Ss. This type of adhesive is well known by the technicians who are connected with this type of work. Since the agglomerate segments are usually made of methacrylic material, the epoxy adhesives offer the advantages of high mechanical properties and high compatibility with the marking strip.

The Sp adhesive layers are applied the full length of the marking strip at intervals that are a multiple of the length of each individual spray layer. This multiple should be, preferably but not critically, four or more.

Using some mechanical means, the asymmetrical-pearl agglomerate platelets are applied to the adhesive layers in a coherent fashion. The platelets become attached to the Sp adhesive layers. The platelets can, however, be attached by means of a melting-type adhesive applied to the underside of the platelets.

The platelets which are to be used, both when applying to marking strips already in service or to marking strips being installed together with the platelets, must be a little narrower than the width of the marking strip, as a rule, and must extend above the strip a distance of at least one millimeter to be able to extend above the film of water formed when it rains.

Figure 4:
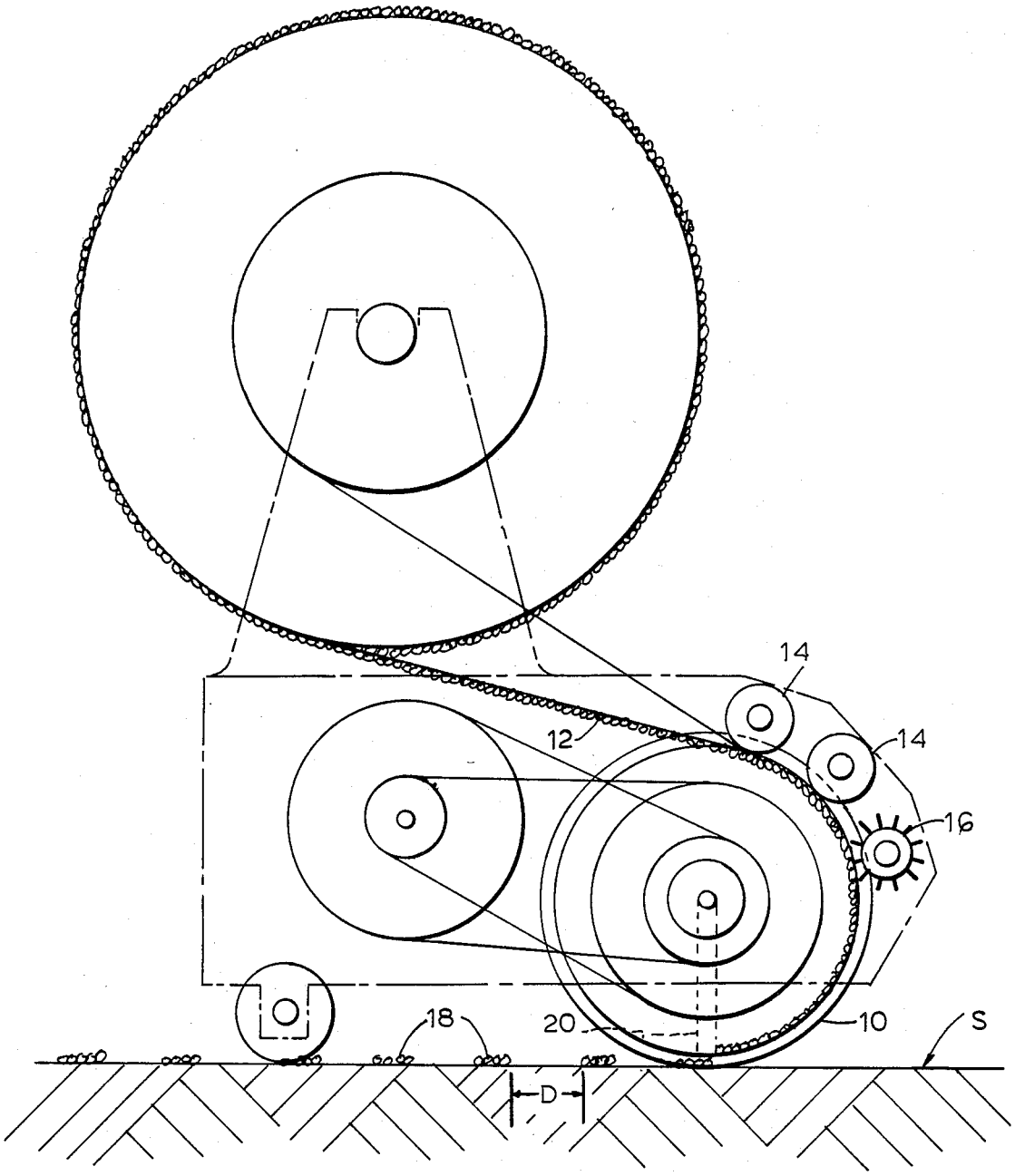

This invention also, as mentioned, provides for the various types of equipment for rapidly depositing the platelets. This equipment can be used both for platelet depositing on roadway markings already in service and on roadway markings in the process of being installed. This equipment, as mentioned, is shown in FIGS. 4 to 7. The relative descriptions follow:

FIG. 4 shows a device for depositing platelets, at a high speed, on roadway markings that are being installed. The ribbon comes in contact with the perforated roller (10). The partial vacuum inside the roller causes the ribbon (12) to adher to the perforated surface of the roller (10). The rubber counter-rollers (14) help the ribbon to adher to the roller (10). The cutting roller (16) then cuts the ribbon into the desired agglomerate units. These units are then deposited in position (18) by means of the air jet (20).

Various types of cutting rollers (16) can be used, according to the number of rows of pearls desired for each deposited agglomerate unit. The distance, D, between the agglomerate units is determined by the rotational speed of the perforated roller (10) and its advancement speed along the roadway surface, S.

Figure 5:
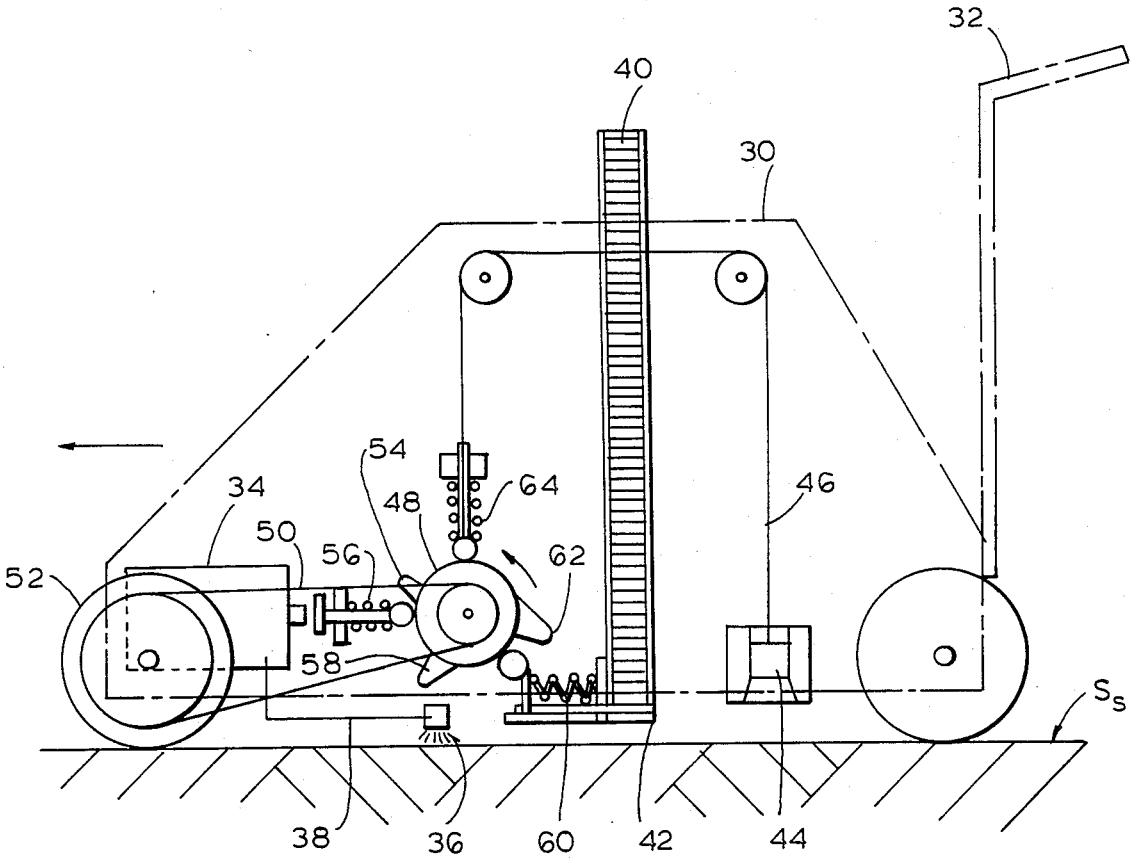
FIGS. 4–7 show schematic representations of the various types of devices for depositing pearl-agglomerate platelets either on marking strips that are already installed or on strips that are in the process of being installed.

FIG. 5 shows a device for depositing pearl agglomerates from a cartridge. This version is shown with a device for spraying the adhesive. This device has a carriage (30) which is hand actuated (32) and which carries the following:

an aerosol bottle (34) containing the adhesive a spray nozzle (36) fed by the bottle (34) through a hose (38) provided with a shut-off valve (not shown but described later)

a battery of one or more containers (40) holding the platelets to be deposited. When there are more than one, they are positioned transversally and can be moved into position for depositing platelets as the preceding containers become empty.

At the depositing position there is an ejector device (42) which pushes out the platelet at the bottom of the container and allows the next platelet to takes its place. The process is then repeated as many times as is required.

A pressing weight (44), actuated by a cable (46), which is allowed to fall onto the deposited platelet to make it adher firmly to the adhesive-coated surface.

A set of appropriately-phased cams (48), mounted on the same axis and driven by the drive chain (50), or other appropriate drive means, connected to one of the wheels (52) of the carriage (30). The first cam (54), of the cam set (48), provides for opening the valve located in the hose between the bottle (34) and the spray nozzle (36). The valve is closed by the spring (56). The second cam (58) actuates the ejection device (42) which pushes out the platelet from the slot at the bottom of the platelet container (40). The ejection device returns by means of the action of the spring (60).

The third cam (62) actuates the lowering of the pressing weight (44). The spring (64) brings the weight back to its original position.

It is obvious that by simply modifying the transmission ratio between the wheels (52) of the carriage (30) and the cam set (48) the distance between the platelets deposited on the marking strip, Ss, can be varied as desired.

Figure 6:
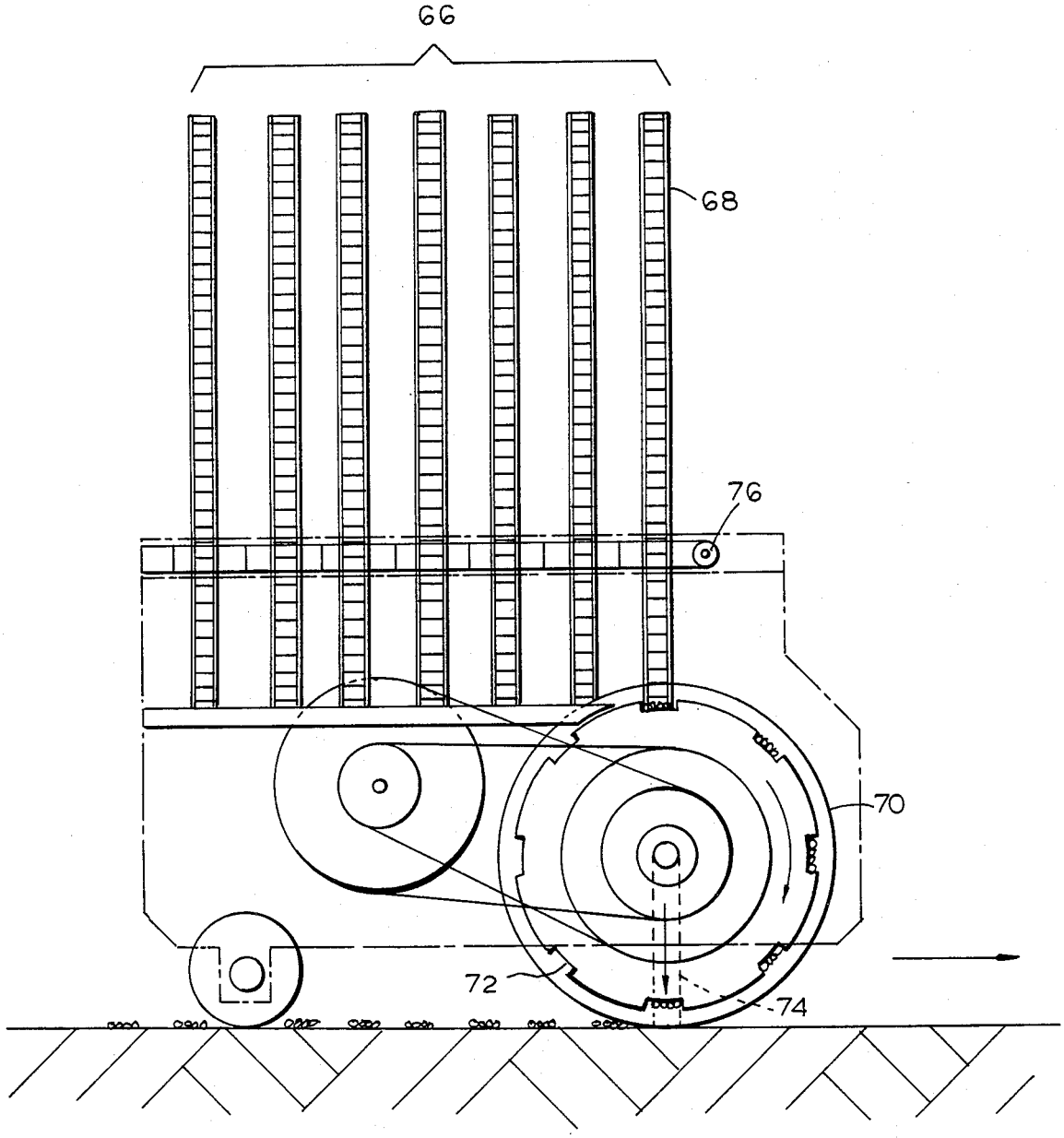

FIG. 6 represents a device for depositing platelets, contained in one or more containers, on roadway markings already in service, by means of a drum similar to that illustrated in FIG. 4. The device is carriage-shaped and moves, for example, in the direction shown by the arrow (65). It is also analogous to the carriages illustrated previously.

A battery of cartridges (66) hold the supply of platelets. The cartridge (68) is in the working position, which corresponds to the position of the drum (70). The drum (70) has appropriate recesses in it (72) for receiving the platelets. A depression is provided in the drum so that as the platelets locate themselves in the recesses (72) they are held in position.

As the drum (70) brings a platelet into the right position, a jet of air coming from the air line (74) blows the platelet out onto roadway surface which, just as in the previously-described cases, has been appropriately covered with a suitable adhesive. The drum (70) is connected by means of a chain to the auxiliary devices. First of all there is the blower which provides both the partial vacuum inside the drum (70) and the pressure inside the air line (74). Then, by means of cams or other such arrangement, it can control the action of such automatic equipment as a pneumatic piston which, in conjunction with a counter, removes the empty cartridges and replaces them with full ones, or the release of a counter-weight or spring which effects the same operation. As an example of the automatic operations that can be incorporated, (76) shows a pneumatic piston which holds the cartridge in the working position. The equipment, of course, does not necessarily have to have the automatic auxiliary devices just mentioned. The operator can just as well perform the operations manually.

Figure 7:
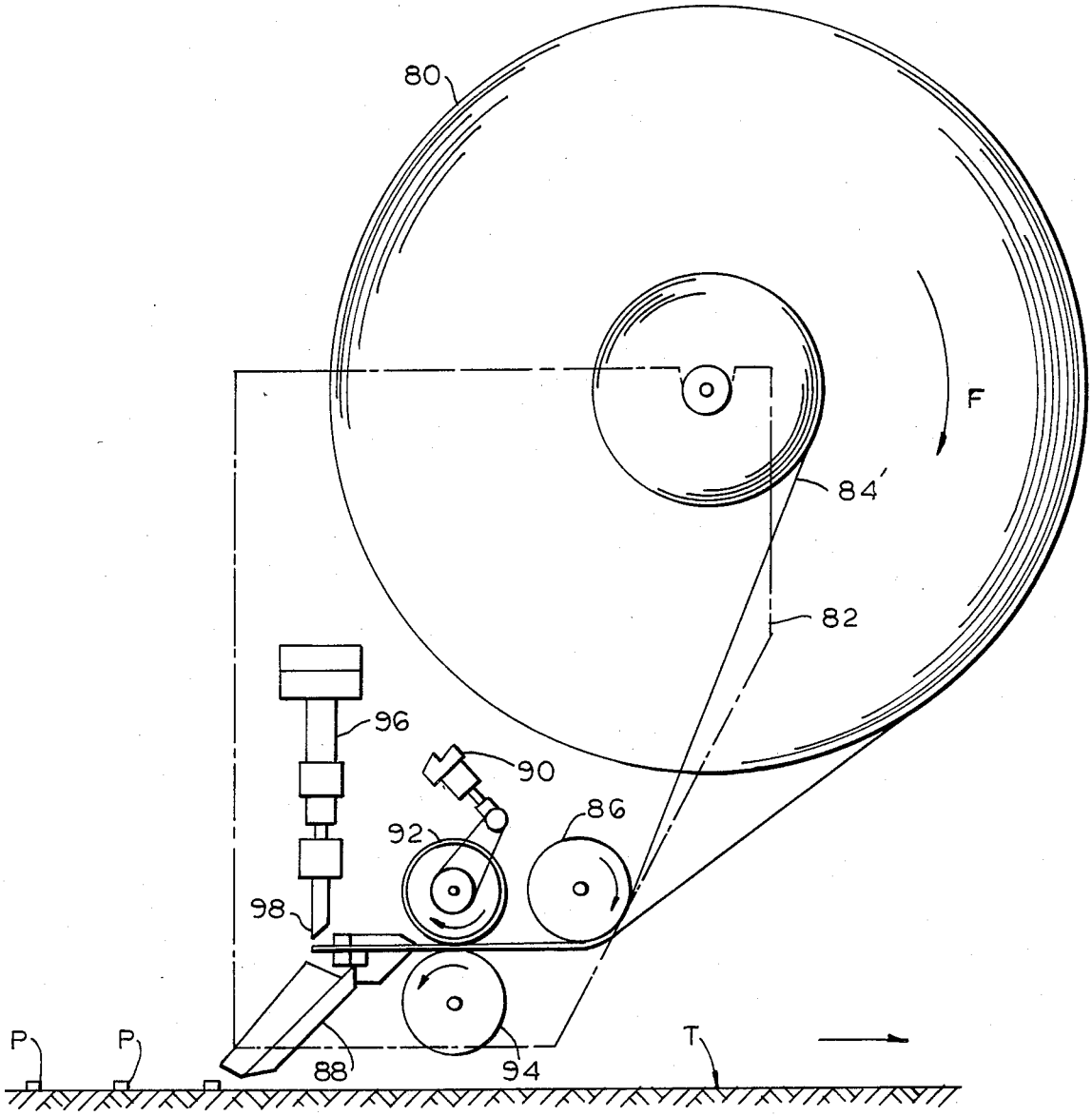

FIG. 7 schematically represents another variation of the equipment for depositing retro-reflecting pearl agglomerate platelets, leaving out the parts not really essential. This equipment has a spindle (80) which is supported in a conventional way at the spindle supports (82). The spindle rotates in the direction shown by the arrow, F, and the marking-strip ribbon (84) unwinds from it. The position of the ribbon when the spindle is full is shown by (84) and (84') shows its position when the spindle is almost empty. The ribbon is sent in the right direction by an idler roller (86) onto a chute (88) from which the sequence of platelets, P, is allowed to fall onto the surface, T.

The piston (90) gives a constant advancement at a fixed distance interval and has an idle return stroke. The transmission means are well known and include a rubber-coated advancement roller (92) with side guides and operating against a counter-roller (94). The equipment includes, among its operational components, an actuating piston (96) which actuates a bending-shearing punch, the end of which is indicated as (98).

I claim:

1. A method for making an installed roadway-marking strip visible in rainy weather, by spraying of an adhesive onto separated small areas of the top surface of a roadway-marking strip already in service, and then depositing agglomerate platelets, each including individual retroreflective elements arranged in rows and interconnected at a distance less than the diameter of the individual element and designed to provide marking-strip visibility under rainy conditions, onto the separated adhesive-covered areas.

2. The method as defined in claim 1, wherein adhesive spraying operations are repeated at predetermined intervals with the separation between the adhesive-covered areas being at least four times the length of the areas, measured prevalently in the direction of the marking strip.

3. A method for making an installed roadway-marking strip, already in service, visible in rainy weather, by the application to the installed roadway-marking strip of agglomerate platelets, each including individual retroreflective elements arranged in rows and interconnected at a distance less than the diameter of the individual element and designed to provide the marking strip with visibility under rainy conditions and applying a meltable adhesive applied to the undersides of the platelets, said adhesive being liquified prior to the application of the platelets to the roadway-marking strip; and further applying a meltable adhesive onto the marking strip at intervals which are at least four times the length of the agglomerate platelet, as measured prevalently in the direction of the marking strip.

* * * * *